US005740552A

United States Patent [19]

Smith

[11] Patent Number: 5,740,552

[45] Date of Patent: Apr. 21, 1998

[54] DISPOSABLE APRONS

[76] Inventor: Dennis B. Smith, 708 Higgins Rd., Champaign, Ill. 61821

[21] Appl. No.: 806,900

[22] Filed: Feb. 26, 1997

[51] Int. Cl.[6] ..... A41B 13/10

[52] U.S. Cl. ..... 2/48; 2/52

[58] Field of Search ..... 2/48, 49.1, 50, 2/51, 52; 209/390, 395

[56] References Cited

U.S. PATENT DOCUMENTS

| | | | |
|---|---|---|---|
| D. 115,086 | 5/1939 | Spanel | 2/48 X |
| D. 232,276 | 8/1974 | Andersson | 2/49.1 X |
| 1,003,489 | 9/1911 | Moritz | 2/50 |
| 2,224,746 | 12/1940 | Richstein | 2/48 |
| 2,282,547 | 5/1942 | Spanel | 2/48 |
| 2,580,388 | 1/1952 | Allen | 2/49.1 |
| 3,131,399 | 5/1964 | Murphy et al. | 2/48 |
| 3,229,875 | 1/1966 | Stoller | 2/49.1 X |
| 3,735,865 | 5/1973 | Smith . | |
| 3,851,760 | 12/1974 | Smith . | |
| 4,055,859 | 11/1977 | Green et al. | 2/48 X |
| 4,215,432 | 8/1980 | Smith . | |
| 4,225,977 | 10/1980 | Smith . | |
| 4,951,318 | 8/1990 | Harveld et al. | 2/48 X |

*Primary Examiner*—C. D. Crowder
*Assistant Examiner*—Shirra L. Jenkins
*Attorney, Agent, or Firm*—Philip L. Bateman

[57] ABSTRACT

A roll of disposable aprons is formed from an elongated strip of plastic film having a portion along each side which is longitudinally folded over the remaining portion of the strip. The strip contains a plurality of latitudinal perforations at spaced intervals to enable the strip to be readily separated into discrete sheets. Each sheet has a cut-out portion near the top and centered latitudinally in the sheet. Each sheet also has a cut-away portion on each side of the hole portion which begins on the outside edge at the top of the strip, then runs inwardly and downwardly, and then ends on the outside edge of the strip. The cut-out portion defines a neck opening and the two strips of the folded-over portions adjacent and inward of the cut-away portions define two waist tie straps.

16 Claims, 2 Drawing Sheets

FIG. 1
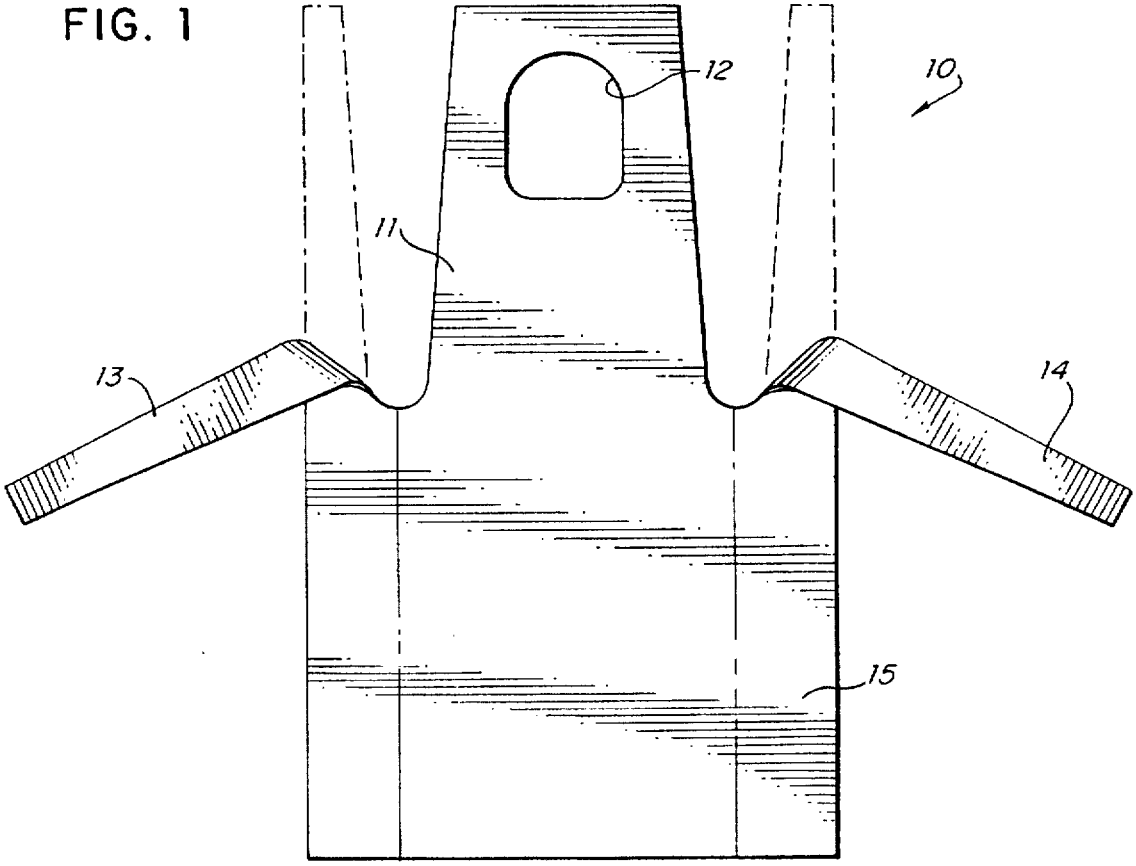
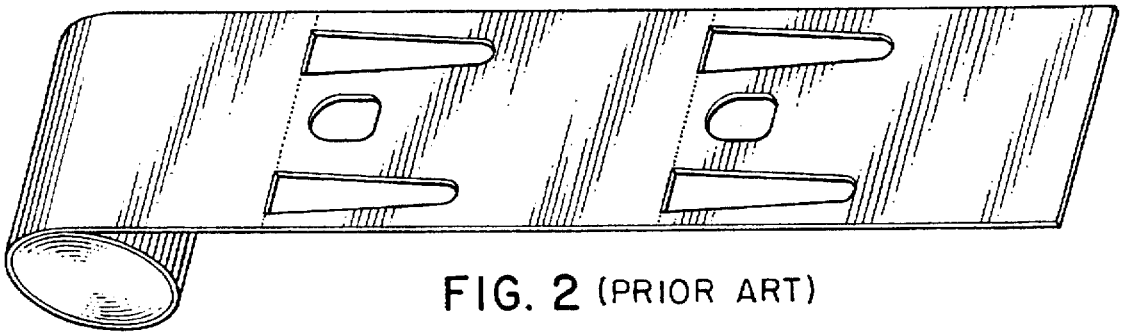
FIG. 2 (PRIOR ART)
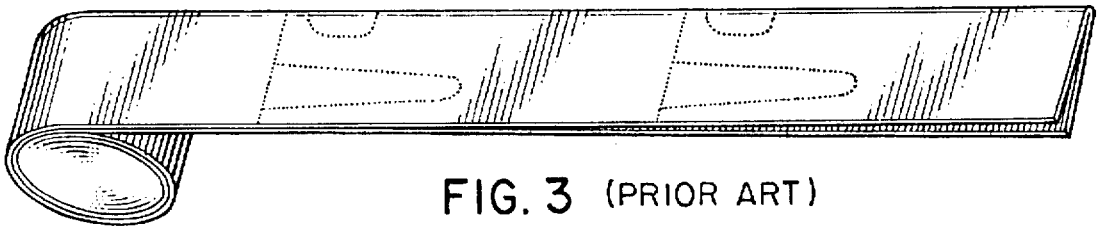
FIG. 3 (PRIOR ART)

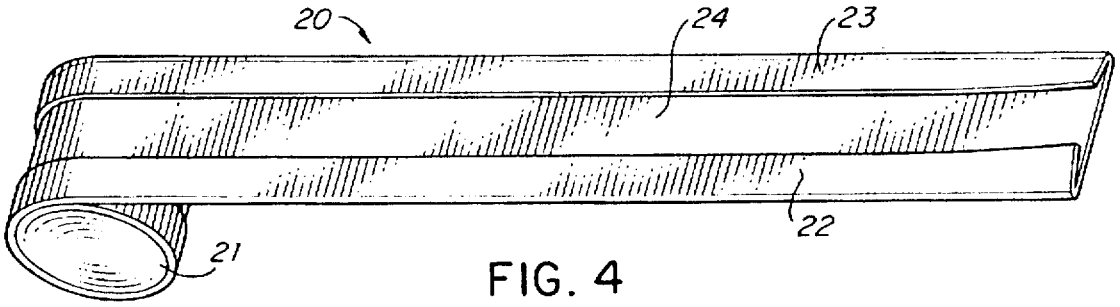
FIG. 4
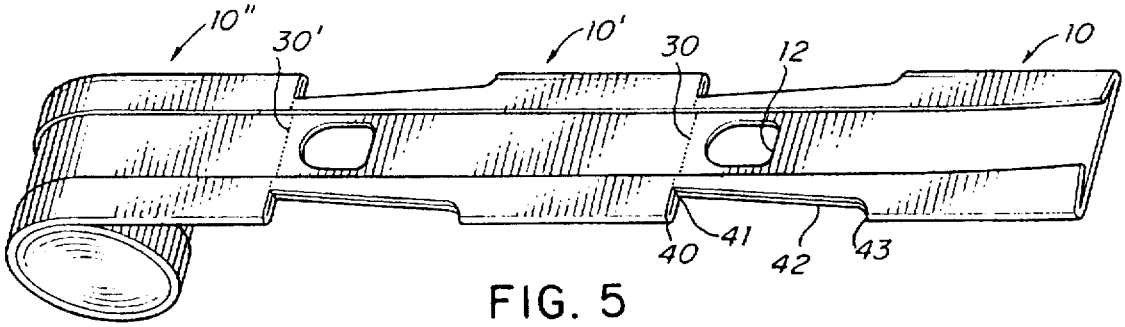
FIG. 5
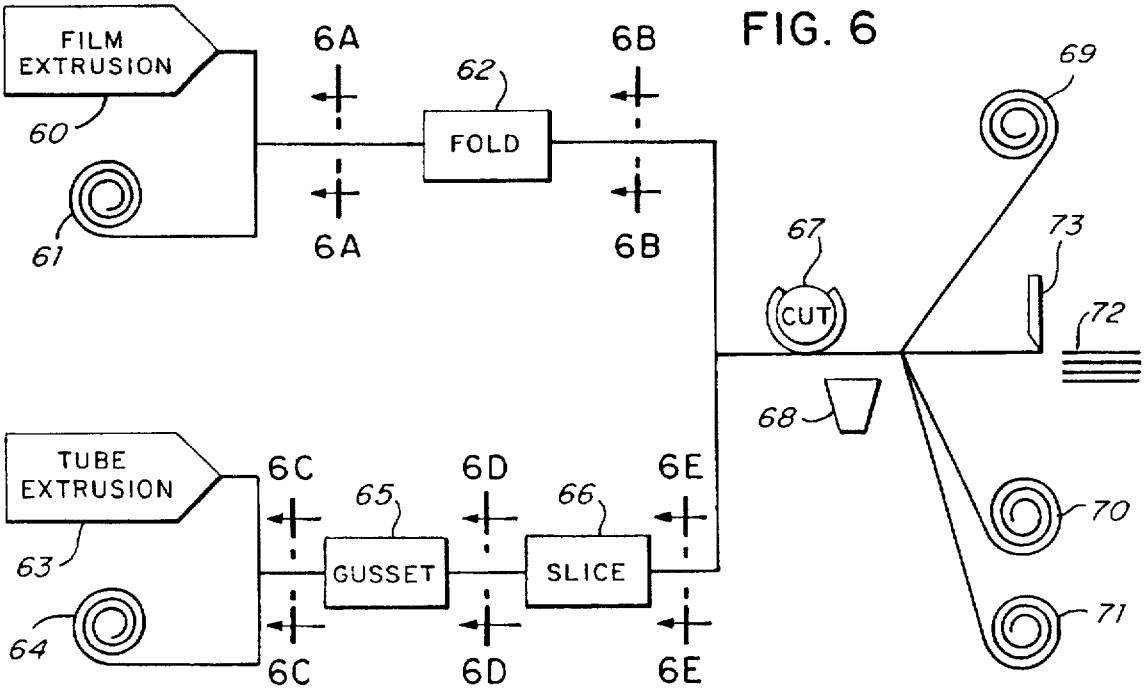
FIG. 6
FIG. 6A FIG. 6B FIG. 6C FIG. 6D FIG. 6E
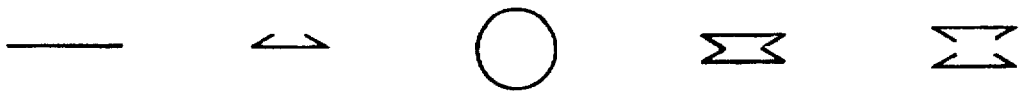

DISPOSABLE APRONS

FIELD OF THE INVENTION

This invention relates to disposable aprons. More particularly, this invention relates to rolls of disposable aprons and methods of making the rolls.

BACKGROUND OF THE INVENTION

An apron is a protective garment that is worn on top of other clothing. There are two common types of aprons. A "kitchen" apron is a rectangular piece of material that covers the front of the body from the waist downward and that contains straps tied at the back of the waist for support. A "bib" apron is similar, but also includes an extended portion of material to cover the chest and stomach. The extension is supported by a yoke worn around the neck. The length of bib aprons varies—some end at mid-thigh, some extend to the knees, and some extend all the way to the feet. All further references to aprons are to the bib type of apron. Aprons are worn on many types of jobs. Years ago, all aprons for industrial and institutional use were made of fabric and were regularly laundered. In recent years, disposable aprons made of lightweight plastic have become more and more popular for such use. A disposable plastic apron is shown in FIG. 1.

Disposable plastic aprons are typically manufactured from an elongated strip of plastic film. During the manufacturing process, the strip is repeatedly perforated and cut. The strip is then wound into a roll for shipping. At the point of use, individual sheets (each one constituting an apron) are pulled off the roll at the perforations. A number of different disposable plastic apron rolls have been disclosed, most notably, Smith, U.S. Pat. No. 3,735,865, issued May 29, 1973; Smith, U.S. Pat. No. 3,851,760, issued Dec. 3, 1974; Smith, U.S. Pat. No. 4,215,432, issued Aug. 5, 1980; and Smith, U.S. Pat. No. 4,225,977, issued Oct. 7, 1980, each of which is incorporated by reference.

Smith, U.S. Pat. No. 4,215,432, discloses a roll of disposable plastic aprons as shown in FIG. 2. The dotted line represent perforations and the unshaded sections represent cut-out openings. When an apron is pulled off the roll, the center opening is placed over the head and around the neck and the two straps are tied behind the waist. This particular roll contains the desirable feature that it has no waste pieces. In other words, the three cut-out portions are removed at the time and place of manufacturing. This enables the portions to be recycled, reduces the shipping weight of the roll, and simplifies the donning of the apron because the wearer does not have to tear out and discard the cut-out portions. Unfortunately, there are a number of disadvantages associated with this roll because of its full width. The primary disadvantage is that standard types of manufacturing equipment are incapable of handling such wide rolls. As a result, specially made equipment must be used. A second disadvantage of the full-width roll is that it must contain a core for support, which increases cost. A third disadvantage is that the roll takes up more space in shipping and storage.

Narrower rolls of disposable plastic aprons are disclosed in the other three Smith patents. A representative roll is shown in FIG. 3. This roll is folded in half longitudinally, i.e., lengthwise, during manufacturing and shipment. The major disadvantage of this roll is that the neck and strap openings must be left on the roll and removed by the user. If these portions were removed during manufacturing, the pulling forces during rolling would create distortions and wrinkles in the plastic film. Accordingly, these portions cannot be easily recycled, the portions add weight to the rolls, and the user must take the time to remove the portions. Another disadvantage of this type of roll is that the user must take the time to unfold the apron before donning it. It can be seen that a demand exists for a roll of disposable plastic aprons that combine the advantages of the rolls shown in FIGS. 2 and 3, namely, narrow width, the elimination of waste portions, and the ability to don the apron without an unfolding step.

SUMMARY OF THE INVENTION

One general object of this invention is to provide an improved roll of disposable aprons. A more particular object is to provide such a roll having a narrow width and having no waste portions. A second general object is to provide an improved method of making such a roll of disposable aprons.

I have invented an improved roll of disposable aprons of the type with a neck opening and two waist tie straps. The roll comprises an elongated strip of plastic film having: (a) a portion of the strip along each side longitudinally folded over upon the remaining portion of the strip, each folded-over portion being about 1/10 to 1/4 the total width of the strip; and (b) a plurality of latitudinal perforations at spaced intervals of about 1/2 to 2 meters to enable the strip to be readily separated into discrete sheets. Each sheet, in turn, has: (i) a cut-out portion located near the top and centered latitudinally in the sheet; and (ii) a cut-away portion on each side of the cut-out portion, each cut-away portion beginning at a point at the top and outside edge of the sheet, then running inward along the perforation to a point at least about 1 cm from the inside edge of the folded-over portion, then running longitudinally downward a distance of about 1/4 to substantially the entire length of the sheet, and then running outwardly to the outside edge of the sheet, each cut-away portion being cut from both the folded-over portion and the remaining portion. Each discrete sheet thus constitutes a disposable apron with the cut-out portion defining a neck opening and the two strips of the folded-over portions adjacent and inward of the cut-away portions defining two waist tie straps.

I have also invented an improved method of making a roll of disposable aprons of the type with a neck opening and two waist tie straps. The method comprises passing an elongated strip of plastic film having a portion of the strip along each side longitudinally folded over upon the remaining portion of the strip, each folded-over portion being about 1/10 to 1/4 the total width of the strip, into contact with: (a) a perforating means to produce on the film a plurality of latitudinal perforations at spaced intervals of about 1/2 to 2 meters to enable the strip to be readily separated into discrete sheets; and (b) a cutting means to produce on each discrete sheet a cut-out portion located near the top and centered latitudinally in the sheet, and a cut-away portion on each side of the cut-out portion, each cut-away portion beginning at a first point at the top and outside edge of the sheet, then running inward along the perforation to a second point at least about 1 cm from the inside edge of the folded-over portion, then running longitudinally downward a distance of about 1/4 to substantially the entire length of the sheet, and then nmning outwardly to the outside edge of the sheet, each cut-away portion being cut from both the folded-over portion and the remaining portion; such that each discrete sheet constitutes a disposable apron with the cut-out portion defining a neck opening and the two strips of the folded-over portions adjacent and inward of the cut-away portions defining two waist tie straps.

The roll of disposable aprons of this invention is folded twice and, therefore, is considerably narrower than an unfolded roll. This narrow width enables a great variety of standard manufacturing equipment, including coreless winders, to be used with the roll. The roll contains no waste material. As a result, weight is reduced, the donning of the aprons is simplified, and the cut-out portions can be easily recycled at the point of manufacture. The cutting pattern of the aprons on the roll has a relatively low lineal distance so that the cost of cutting dies and their maintenance is reduced.

BRIEF DESCRIPTION OF THE DRAWINGS

FIG. 1 is a plan view of a disposable apron.

FIG. 2 is a perspective view of the roll of disposable aprons disclosed in Smith, U.S. Pat. No. 4,215,432.

FIG. 3 is a perspective view of the roll of disposable aprons disclosed in Smith, U.S. Pat. No. 3,735,865.

FIG. 4 is a perspective view of a roll of plastic film containing two longitudinal folds which is ready for perforation and cutting in accordance with the method of this invention.

FIG. 5 is perspective view of a roll of disposable aprons of this invention.

FIG. 6 is a flow sheet of a method of making the rolls of disposable aprons.

FIGS. 6A, 6B, 6C, 6D, and 6E are cross-sectional details of FIG. 6.

DETAILED DESCRIPTION OF THE INVENTION

This invention is best understood by reference to the drawings. FIG. 1 shows a disposable apron 10 of the type to which this invention pertains. The apron contains a bib portion 11 (the part above the waist), a neck opening 12, two waist tie straps 13 and 14, and a lower portion 15 (the part below the waist). The apron has an overall length (from top to bottom) of about ½ to 2 m (about 17 to 79 in), preferably about 1 to 1½ m (about 39 to 59 in), and most preferably about 1 1/10 to 1 1/3 m (about 43 to 51 in). Aprons less than about ½ m in length cover little of the area below the waist while aprons more than about 2 m tend to drag the floor, even when worn by tall people. The lower portion of the apron has a width of about 50 to 90 cm (about 20 to 35 in), preferably about 60 to 80 cm (about 24 to 32 in), and most preferably about 65 to 75 cm (about 26 to 30 in).

The apron is made of a plastic film having sufficient thickness and tensile strength to resist tearing. A wide variety of plastic film materials are suitable, including monofilms, monofilm/nonwoven laminates, spunbonded and meltblown nonwoven fabrics, and composite olefin fabrics. Plastic monofilms are preferred because of their low cost. Examples of monofilms include polyolefins, such as polyethylene and polypropylene, polyvinyl chloride, vinylidene chloride polymers, rubber hydrochloride, polyesters, and cellulose esters. Polyethylene is the preferred monofilm because of its physical properties and low cost. The plastic film typically has a thickness of about 10 to 250 μm (about 0.5 to 10 mils or thousandths of an inch) and preferably about 25 to 50 μm (about 1 to 2 mils). As the thickness decreases, both the strength of the apron and the costs of material decrease. If the thickness is less than about 10 μm, the apron is so lightweight that it tends to cling to the body rather than drape. As the thickness increases, the costs of material and shipping increase.

Turning now to FIG. 4, the disposable apron is manufactured from a strip 20 of plastic film, most of which is shown tightly wound into a roll 21. A short section at the bottom end of the strip is shown unwound for illustration purposes. Two portions 22 and 23 of the strip along each side are longitudinally folded over upon the remaining, underlying portion 24 of the strip. The two folded-over portions have the same, or about the same, width. The width is generally about 1/10 to ¼ the total width of the strip. For example, if the total width of the strip is 70 cm, each folded-over portion has a width of about 7 to 18 cm. It will be seen that the waist tie straps of the apron are cut from the folded-over portions. If the width of the folded-over portions is less than about 1/10 of the total, the waist straps are so narrow that they are prone to tearing. If the width is greater than about ¼ of the total, the folded-over portions extend over the center cut-out portion. In addition, the waist straps are so wide that they are difficult to tie. Excessively-wide waist straps also represent a waste of material. The folded-over portions preferably have a width of about ⅛ to ⅕ the total width of the strip, and most preferably a width of about ⅙ to ⅕ the total width of the strip.

FIG. 5 shows the folded roll of plastic film after it has been cut and perforated to transform it into the roll of disposable aprons of this invention. The roll has latitudinal, i.e., transverse, perforations 30 and 30' at spaced intervals of about ½ to 2 m which divide the roll into discrete sheets. The spaced interval of perforations determines the overall length of the sheets and, in turn, the overall length of the individual aprons. The length is a matter of choice, depending on the size of the persons who will wear the apron and the amount of coverage desired. As previously discussed, an apron having a length less than about ½ m does not cover the body below the waist and an apron longer than 2 m tends to drag on the floor. The perforations are extensive enough that an individual sheet can be easily pulled manually from the roll, but not so extensive that individual sheets are separated during the winding that follows the perforating. In FIG. 5, the sheet/apron at the bottom of the roll is designated 10. The next sheet on the roll is designated 10', the next sheet 10", and so on.

Each sheet/apron on the roll contains a cut-out hole portion 12 located near the top, generally within about 1 to 8 cm (about ½ to 3 in). The cut-out portion is further centered latitudinally in the sheet. The cut-out portion defines the neck opening and is sized to fit over the head of the wearer. The opening generally has a diameter of about 15 to 20 cm (about 6 to 8 in). The shape of the opening is not critical—rounded, oval, or partially curved and partially straight (as shown in FIG. 4) are all suitable.

Each sheet/apron on the roll also contains cut-away portions on each side of the cut-out hole portion. The cut-away portions are of double thickness because they are cut from the folded-over portion of the strip and from the remainder of the strip underlying the folded-over portion. Each cut-away portion begins on the outside edge at the top of the strip, runs inwardly and downwardly, and then ends on the outside edge of the strip. More specifically, each cut-away portion begins at a first point 40 at the top of the sheet on the outside edge of the folded-over portion. The cut-away portion then runs inwardly along the perforation to a second point 41 which is at least about 1 cm (about ½ in) from the inside edge of the folded-over portion. It can be seen that the distance between the second point and the inside edge determines the width of the end of the waist tie straps. If the second point were all the way to the inside edge, there would be nothing left to hold the folded-over portion to the folded-over portion of the adjoining sheet. This, in turn, would allow the folded-over portions to become unfolded during winding. If the second point were closer than about 1 cm to the inside edge, the possibility of the remaining connection pulling away at the perforation would be too great. At the other extreme, it is acceptable to locate the second point on the outside edge of the folded-over portion so that the first and second points are the same. This location maximizes the distance connecting the folded-over portions of adjoining sheets, but also tends to make tying the waist straps more difficult due to the width of the strap. It is preferred that the second point is located about 5 to 10 cm (about 2 to 4 in) from the inside edge.

From the second point, the cut-away portion then runs longitudinally down the folded-over portion, i.e., between the inside and outside edges of the folded-over portion, along path 42. It can be seen that the downward distance determine both the length of the waist straps and the location of the waist straps relative to the apron. The downward distance is generally about 40 to 70 cm (about 16 to 28 in) and preferably about 50 to 60 cm (about 20 to 24 in). Expressed in terms of the overall length of the apron, the distance is about ¼ the length of the apron (when the apron extends to near the feet) to substantially the entire length of the apron (when the apron covers little below the waist). The downward path of the cut-away portion determine the shape of the waist straps and is, to a large extent, a matter of choice. In FIG. 5, the path veers slightly outwardly so that the resulting waist straps taper accordingly. However, other paths are also suitable, including paths that veer inwardly, paths that run parallel to the outside edge, and paths that curve or veer as they move downward. Finally, the cut-away portion runs back to a point 43 on the outside edge of the strip.

The pattern of the cut-out and cut-away portions is responsible for a number of significant benefits. First, the pattern is symmetrical and the resulting even distribution of forces during winding enables the strip to be wound at a high speed without any distortion. Second, the lineal distance of the cut-away portion is exactly one-half of what it would be if the folded-over portion were not present. This reduction in lineal distance reduces the initial cost and maintenance cost of the cutting die. Third, the pattern enables all the waste portions to be removed at the point of manufacture. As previously mentioned, this reduces weight and enables the removed portions to be recycled. And fourth, the pattern also simplifies the donning of the apron. The user simply grasps the sheet near the top where the perforations are located and pulls. Thus, when the sheet is pulled off, the apron is held at the top without any need for the wearer to remove any waste portion or to regrip the apron. Furthermore, after the neck opening is placed over the head, the two folded-over portions unfold automatically as the waist tie straps are taken into the hands and tied.

FIG. 6 illustrates four methods of manufacturing the roll of disposable aprons of this invention. The first method is to begin with a strip of plastic film produced on site in a film extruder 60. A second method is to begin with an unfolded roll 61 of plastic film. In either case, the film is passed to a folding means 62 to impart the two longitudinal folds. FIG. 6A is a cross-sectional detail of the film prior to folding and FIG. 6B is a cross-sectional detail after folding. After folding, the strip is ready for perforating and cutting.

A third method of manufacturing begins with a tube extruder 63 which produces a continuous tube of plastic film. A fourth method is to begin with a roll 64 of plastic film tubing. FIG. 6C is a cross-sectional detail of the tubing. The tubing is first folded into a shape having two triangular indentations, commonly known as gussets, in the gusseting means 65. FIG. 6D is a cross-sectional detail of the gusseted tubing. The tubing is then slit longitudinally along the gusset in the slicing means 66. The result of the slicing is two separate folded strips as shown in cross-sectional detail in FIG. 6E.

The next step of the manufacturing process is for the folded strip(s) to be perforated and cut by the perforating and cutting means 67, which is typically a rotary die. The cut-out and cut-away portions are removed from each sheet by conventional means and collected in a reservoir 68. The cut-out and cut-away portions are discarded, saved for future recycling, or immediately recycled back to an extruder.

The perforated and cut strip is then typically wound into a roll 69. The strip is sufficiently narrow that existing commercial coreless winders can be used. Eliminating the core reduces cost in several ways—the cost of the core itself is eliminated and the size of the roll is reduced which reduces packaging and shipping costs. Alternatively, the strip can be wound onto a core made of cardboard or the like if desired by the customer or required by the manufacturing equipment. If two strips are perforated and cut simultaneously, they are typically wound onto two separate rolls 70 and 71. If desired, the aprons can be separated at the time of manufacturing and shipped in the form of a stack 72. The separation is accomplished by an additional cutting means 73, by a mechanical or manual separation of the aprons at the perforations, or by simply substituting a complete cut for the latitudinal perforation.

When a laminated apron is desired, the above-described methods are used with the exception that a roll of laminated film is used as the starting material or a second strip of material is superimposed on the first strip of material by suitable means, such as passing the two strips between two rolls which crimp or activate adhesives to bond the two strips together.

The roll of disposable aprons is optionally imprinted with company names, logos, or other indicia. Preprinted roll stock is used or the imprinting is performed at the time of manufacture in a variety of conventional ways, including embossing and printing. When imprinting is performed at the time of manufacture, it is typically performed immediately before the strip is cut and perforated.

I claim:

1. A roll of disposable aprons of the type with a neck opening and two waist tie straps, the roll comprising an elongated strip of plastic film having:

(a) a portion of the strip along each side longitudinally folded over upon the remaining portion of the strip, each folded-over portion being about 1/10 to ¼ the total width of the strip; and (b) a plurality of latitudinal perforations at spaced intervals of about ½ to 2 meters to enable the strip to be readily separated into discrete sheets; each sheet having:

(i) a cut-out portion located near the top and centered latitudinally in the sheet; and (ii) a cut-away portion on each side of the cut-out portion, each cut-away portion beginning at a first point at the top and outside edge of the sheet, then running inward along the perforation to a second point at least about 1 cm from the inside edge of the folded-over portion, then running longitudinally downward a distance of about ¼ to substantially the entire length of the sheet, and then running outwardly to the outside edge of the sheet, each cut-away portion being cut from both the folded-over portion and the remaining portion;

such that each discrete sheet constitutes a disposable apron with the cut-out portion defining a neck opening and the two strips of the folded-over portions adjacent and inward of the cut-away portions defining two waist tie straps.

2. The roll of disposable aprons of claim 1 wherein the plastic film comprises a monofilm.

3. The roll of disposable aprons of claim 2 wherein the latitudinal perforations are spaced at intervals of about 1 to 1½ m.

4. The roll of disposable aprons of claim 3 wherein the total width of the strip is about 60 to 80 cm.

5. The roll of disposable aprons of claim 4 wherein each folded-over portion is about ⅛ to ⅕ the total width of the strip.

6. The roll of disposable aprons of claim 5 wherein the second point of the cut-away portions is located about 5 to 10 cm from the inside edge of the folded-over portion.

7. The roll of disposable aprons of claim 6 wherein the plastic monofilm comprises polyethylene and has a thickness of about 10 to 250 μm.

8. The roll of disposable aprons of claim 7 wherein the cut-away portion runs longitudinally downward a distance of about 40 to 70 cm.

9. A method of making a roll of disposable aprons of the type with a neck opening and two waist tie straps, the method comprising passing an elongated strip of plastic film having a portion of the strip along each side longitudinally folded over upon the remaining portion of the strip, each folded-over portion being about 1/10 to ¼ the total width of the strip, into contact with:

(a) a perforating means to produce on the film a plurality of latitudinal perforations at spaced intervals of about ½ to 2 meters to enable the strip to be readily separated into discrete sheets; and (b) a cutting means to produce on each discrete sheet a cut-out portion located near the top and centered latitudinally in the sheet, and a cut-away portion on each side of the cut-out portion, each cut-away portion beginning at a first point at the top and outside edge of the sheet, then running inward along the perforation to a second point at least about 1 cm from the inside edge of the folded-over portion, then running longitudinally downward a distance of about ¼ to substantially the entire length of the sheet, and then running outwardly to the outside edge of the sheet, each cut-away portion being cut out from both the folded-over portion and the remaining portion; such that each discrete sheet constitutes a disposable apron with the cut-out portion defining a neck opening and the two strips of the folded-over portions adjacent and inward of the cut-away portions defining two waist tie straps.

10. The method of claim 9 wherein the plastic film comprises a monofilm.

11. The method of claim 10 wherein the latitudinal perforations are spaced at intervals of about 1 to 1½ m.

12. The method of claim 11 wherein the total width of the strip is about 60 to 80 cm.

13. The method of claim 12 wherein each folded-over portion is about ⅛ to ⅕ the total width of the strip.

14. The method of claim 13 wherein the second point of the cut-away portions is located about 5 to 10 cm from the inside edge of the folded-over portion.

15. The method of claim 14 wherein the plastic monofilm comprises polyethylene and has a thickness of about 10 to 250 μm.

16. The method of claim 15 wherein the cut-away portion runs longitudinally downward a distance of about 40 to 70 cm.

* * * * *